US005100357A

United States Patent [19]

MacCready et al.

[11] Patent Number: 5,100,357

[45] Date of Patent: Mar. 31, 1992

[54] TOY AIRCRAFT AND METHOD OF FLIGHT CONTROL THEREOF

[75] Inventors: Tyler MacCready, Pasadena; Martyn B. Cowley, Simi Valley; Taras Kiceniuk, Jr., Santa Paul, all of Calif.; Parker MacCready, Seattle, Wash.; Walter R. Morgan; Matthew R. Kruse, both of Simi Valley, Calif.

[73] Assignee: Aerovironment, Inc., Calif.

[21] Appl. No.: 522,243

[22] Filed: May 10, 1990

[51] Int. Cl.[5] ..... A63H 27/00

[52] U.S. Cl. ..... 446/61; 446/68; 446/35

[58] Field of Search ..... 446/61, 62, 63, 66, 446/67, 68, 34, 35; 273/67 B, 317; 416/1

[56] References Cited

U.S. PATENT DOCUMENTS

| | | | |
|---|---|---|---|
| 781,104 | 1/1905 | Slinn | 446/35 |
| 1,420,805 | 6/1922 | Baehr | 446/67 |
| 2,198,509 | 4/1940 | Burke | 446/218 |
| 2,718,092 | 9/1955 | Grant | 446/61 |
| 2,784,524 | 3/1957 | Jackle | 446/61 |
| 3,153,877 | 10/1964 | Effinger et al. | 446/61 X |
| 3,626,555 | 12/1971 | Albertini et al. | 446/35 |
| 4,195,438 | 4/1980 | Dale et al. | 446/35 |
| 4,206,892 | 6/1980 | MacCready, Jr. et al. | 244/45 |
| 4,388,777 | 6/1983 | Hermann et al. | 446/61 |
| 4,836,817 | 6/1989 | Corbin | 446/63 X |

FOREIGN PATENT DOCUMENTS

| | | | |
|---|---|---|---|
| 547738 | 10/1957 | Canada | 446/35 |
| 9006794 | 6/1990 | PCT Int'l Appl. | 446/35 |
| 17154 | of 1910 | United Kingdom | 446/35 |

OTHER PUBLICATIONS

"Flying Toys", Imperial Toy Corporation, 2060 East 7th Street, Los Angeles, CA 90021 (1977).

"Sketchbook", *American Modeler*, Apr. 1958, p. 11.

*Primary Examiner*—Mickey Yu
*Assistant Examiner*—D. Neal Muir
*Attorney, Agent, or Firm*—William W. Haefliger

[57] ABSTRACT

A toy airplane is launched; and an air flow deflecting surface is located in spaced relation to a V-shaped, swept-back wing of the airplane to deflect air flow generally upwardly toward the flight path of the airplane to aid in sustaining or balancing its flight. That surface is movable relative to the wing, and may be hand-held beneath the flying wing. In a modification, a separate stabilizer surface may be connected to the wing to dangle, forwardly thereof.

8 Claims, 4 Drawing Sheets

FIG. 7.
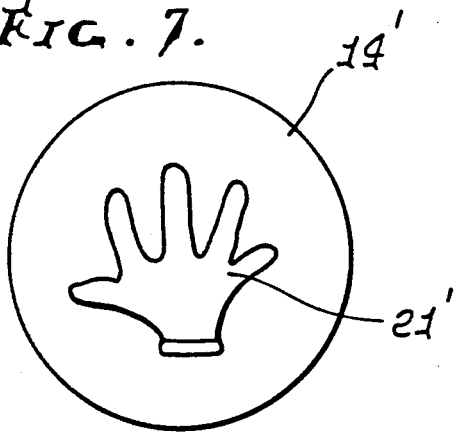
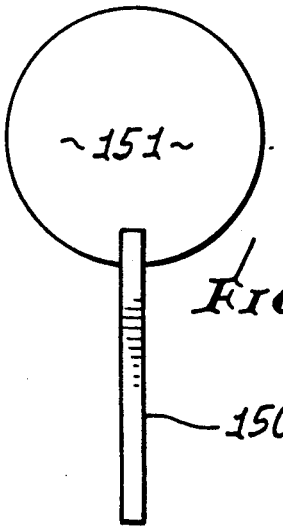
FIG. 7a.
FIG. 14.
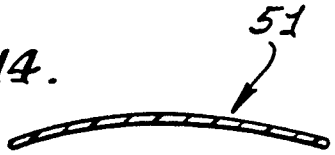
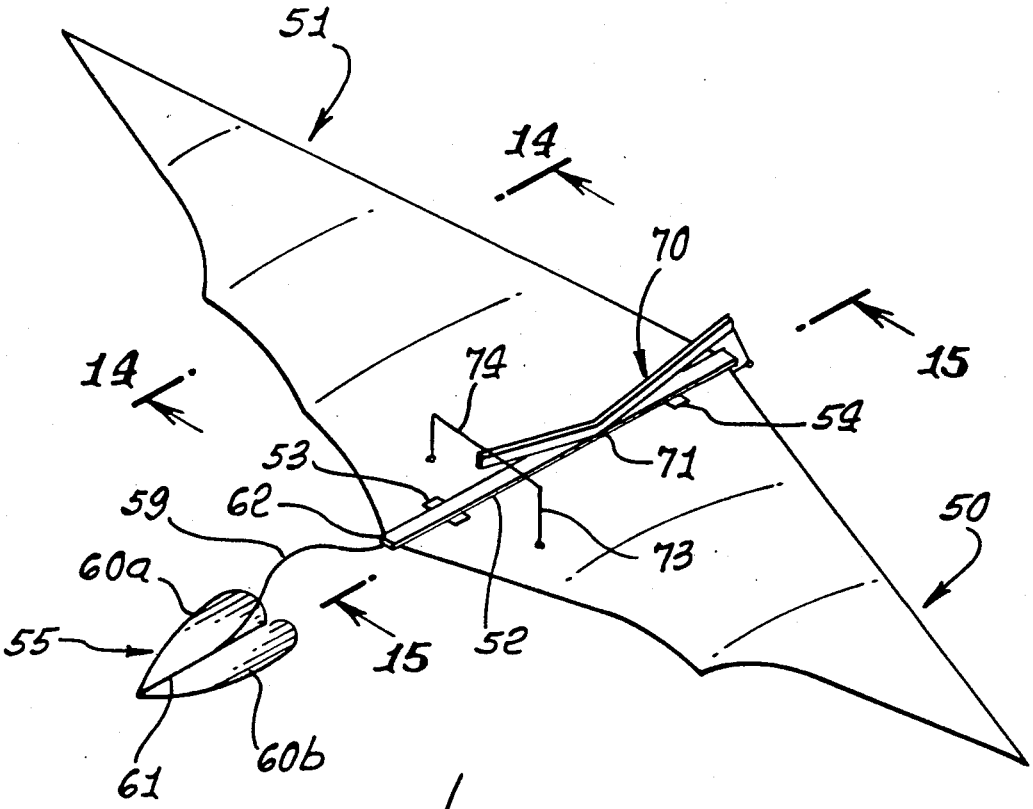
FIG. 13.

TOY AIRCRAFT AND METHOD OF FLIGHT CONTROL THEREOF

BACKGROUND OF THE INVENTION

This invention relates generally to toy aircraft, and more particularly concerns a wing that is capable of sustained flight, and the method of achieving same as by use of an air deflecting surface that is hand-held beneath the wing, or by use of an actuator on the wing to effect wing-section flapping.

Small, hand-launched gliders have always in the past been incapable of sustained flight due to lack of power, weight factors, and failure or diminishing air current up-drafts. Also, such gliders have not been selectively controllable by humans, without the use of radio or control lines. Efforts to overcome these limitations have, to our knowledge, not met with success.

SUMMARY OF THE INVENTION

It is a major object of the invention to provide a toy flying wing, and method of control of same which overcomes the above-described problems, difficulties and limitations.

Basically, the invention embodies apparatus including a toy aircraft adapted to be launched and sustained in its flight path at least in part due to deflection of relative air flow, the aircraft comprising a) a generally swept back, V-shaped wing of lightweight construction, and b) a weight suspended to extend generally forwardly of said wing and connected thereto, for balance thereof.

The aircraft itself may consist of a generally swept-back, V-shaped wing of lightweight construction, and a simple weight suspended to extend forwardly of the central portion of the wing, for balance purposes. As for design characteristics enabling sustained flight, the aircraft typically comprises a glider having the sweep-back angularity of its wing section typically between 25° and 40°; the glide ratio being in excess of 4, and the aspect ratio in excess of 5. A control surface maneuvered beneath the flight path may consist of a sheet of material, and advantageously may be a component of a kit that includes or contains the glider for shipment, and a handle may be provided in association with the surface, to enable manual maneuvering of same, beneath the flying wing. That handle may project downwardly and enhance maneuverability.

Maneuvering of the control surface may include, for example, relatively forwardly advancing the surface generally parallel to and beneath the aircraft or glider flight path to create or deflect the air flow upwardly with the surface maintained angled upwardly and rearwardly relative to the direction of forward advancement; and such maneuvering also includes altering the upward air flow to cause the glider to execute a turn, as by displacing the forwardly moving surface laterally relative to the glider. Further, the surface may be raised or lowered, or moved forwardly or rearwardly, to effect climbing or dropping of the glider; the surface may be advanced by a human who walks or runs with it, or holds it in the path of an impinging air stream; and the glider may initially be hand launched prior to such control. As a result, controlled and sustained glider flight within a building, such as a home, becomes possible. Outdoor flight is also contemplated.

In another form of the invention, the control surface is connected to dangle from a wire projecting forwardly of a nose defined by the wing. In that position, the dangling surface provides flight stabilization, as will be seen. Also, the wing may have left and right sections hingedly supported to move up and down, and an actuator may be carried by a frame to which the wing sections are connected to displace them up and down. Further, the actuator may include a forwardly and rearwardly extending rocking beam supported by the frame, links connected between the wing sections and the beam to be displaced up and down by the beam, a rotary part carried by the wing to be rotated by torque exerted by an unwinding elastomeric band, and a crank operatively connected between the rotary part and the beam to rock the beam as the part is rotated.

These and other objects and advantages of the invention, as well as the details of an illustrative embodiment, will be more fully understood from the following specification and drawings, in which:

DRAWING DESCRIPTION

FIG. 7 is an elevation showing a glove attached to an air deflector sheet; and FIG. *7a* shows use of an elongated handle;

FIG. 13 is a perspective view showing a modified toy aircraft;

FIG. 14 is a section taken on lines 14—14 of FIG. 13;

DETAILED DESCRIPTION

Figure 1:
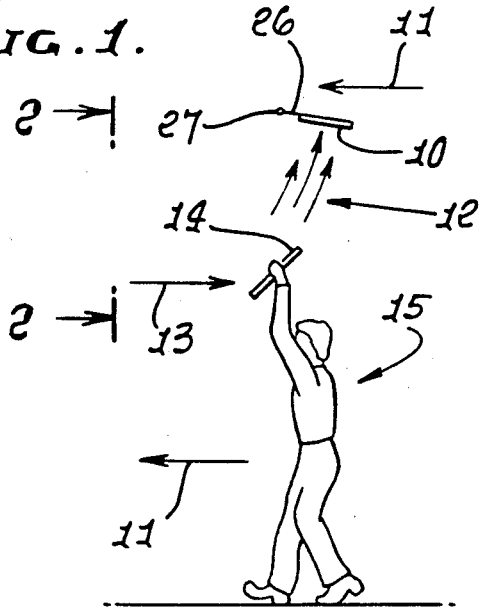
FIG. 1 is a side elevational view showing control of flight of the toy airplane.
Figure 2:
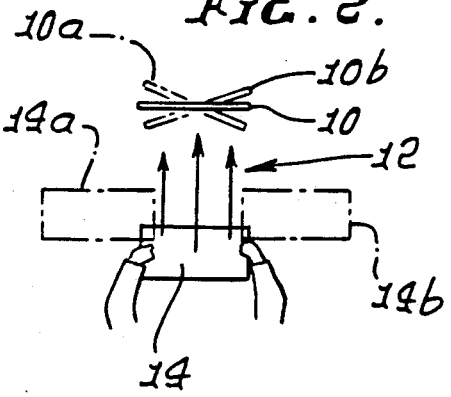
FIG. 2 is a front elevational view on lines 2—2 of FIG. 1.

In FIGS. 1 and 2, a lightweight toy glider 10 is shown as launched in its flight path direction (indicated by arrow 11) and sustained at flight elevation by upwardly directed air currents indicated by arrows 12. Such upward air flow is achieved by upward deflection of relative rightward air flow indicated by arrow 13. As to the latter, the flow 13 is relative to and toward a surface 14 angled upwardly and rearwardly relative to the glider and its forward flight path direction 11. Surface 14 may be defined by a plane, sheet or other object which is portable and typically carried by a human "user" or "controller" 15 of the toy glider. The user's body surfaces may also be used for this purpose. He may move in direction 11, as shown, to transport surface 14 in that direction, creating upward air currents 12; or, he may stand still, or even move rearwardly, with wind blowing in direction 13 to produce air deflection by surface 14 and resultant upward air flow 12. The surface 14 is typically located generally beneath the flight path of the glider; also, the surface is located and maneuvered in such proximity to the glider that, as related to the size and shape of the surface, and the wind velocity relative to and toward the surface, sufficient upward air flow is provided toward the glider flight path as to sustain the glider in flight. In this regard:

a) sufficient lowering of the surface tends to diminish the upward air flow reaching the glider, so that the glider loses altitude;

b) sufficient raising of the surface tends to increase the upward air low reaching the glider, so that the glider gains altitude;

c) moving the surface 14 to one side relative to the glider, as from solid line position in FIG. 2 to broken line position 14*a* tends to cause the glider wing to bank in one direction, as at 10*a* in FIG. 2, so that the glider executes a turn (i.e., move surface to left, and glider banks to right);

d) moving the surface to the opposite side relative to the glider, as to broken line position 14*b*, tends to cause the glider wing to bank in the opposite direction as at 10*b* in FIG. 2, so that the glider executes an opposite turn;

e) moving the surface forwardly relative to the glider causes pitch up, and decreased velocity of the glider; and f) moving the surface rearwardly relative to the glider causes pitch down and increased velocity of the glider.

Further, the glider may be launched from surface 14 by flipping it upwardly.

Figure 6:
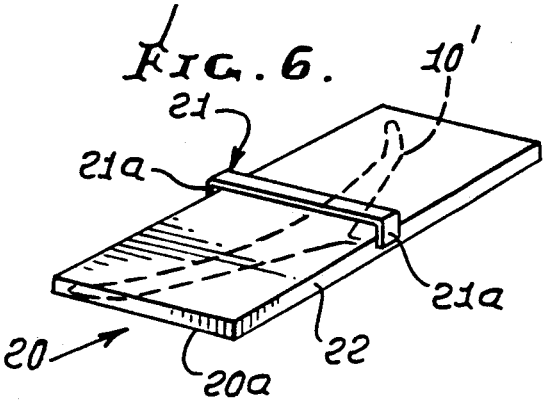
FIG. 6 is a view of a carton containing the glider.

The surface 14 may be defined by a component of a kit sized to receive the glider for shipment. Such a component may comprise a bottom wall 20*a* of carton 20 as for example is seen in FIG. 6. The carton may be generally rectangular, between 6 and 12 inches wide, and between 12 and 24 inches long, so as to be easily manually manipulated, and it may consist of cardboard, plastic or other material. Further, a handle 21 may be attached or attachable to the carton, as at handle ends 21*a* secured to carton side walls 22, the handle accommodating easy manual maneuvering of the carton to present the surface of bottom wall 20*a* in the manner of surface 14 in FIGS. 1 and 2. The glider is shown in broken lines 10' in the carton in FIG. 6, for shipment or storage. A modified handle 21 is shown in FIG. 7 to comprise a glove 21' attached to the end of a disc-shaped sheet 14; sheet 14 may also be considered to be flexible, i.e., expansible to the size shown, and also collapsible. One example would be a webbed glove. FIG. 7*a* shows an elongated handle 150 attached to a sheet 151, enhancing range and maneuverability.

Figure 4:
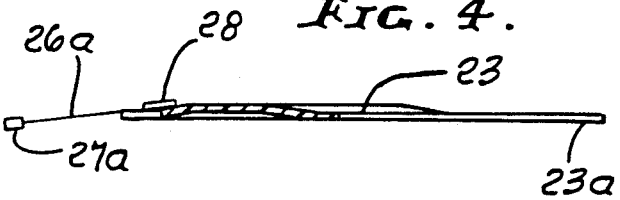
FIG. 4 is a section on lines 4—4 of FIG. 3.
Figure 3:
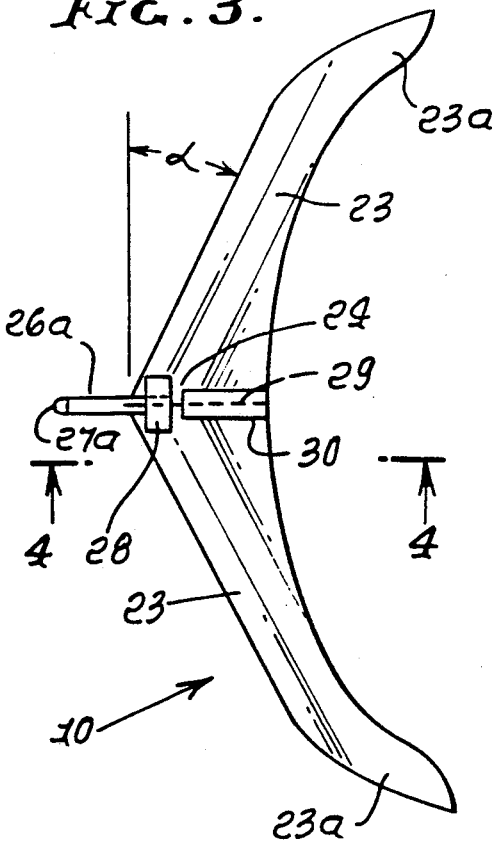
FIG. 3 is an enlarged plan view of the toy airplane.

Referring to FIGS. 3 and 4, the glider 10 is shown as having a swept back (i.e., V-shaped) wing 23, without a body or fuselage; however, a body may be used. It typically has a glide ratio exceeding 4, and an aspect ratio exceeding 5, for enabling flight control in the manner as described above. The wing material consists of balsa wood, or plastic, such as styrofoam, or paper. The chord dimension of each wing typically diminishes from the wing central junction area 24 outwardly toward each wing tip, the latter being further swept back if desired, as shown at 23*a*. Also, the wing chordal cross section, as seen in FIG. 4, is upwardly slightly arched. Some upward reflex may be employed at the rear of the wing.

Figure 5:
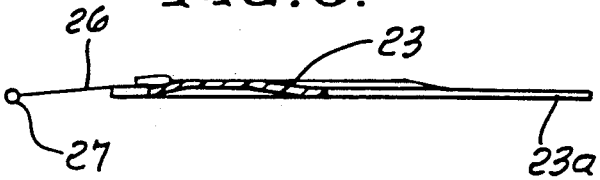
FIG. 5 is a view like FIG. 4 but showing a modification.

For balance purposes, a small weight is suspended by the wing to project forwardly, or may be embedded in the wing. As shown in FIGS. 1 and 5, the weight comprises a metal wire 26, and a small mass 27 such as wax is attached to the tip of the wire. In FIGS. 3 and 4, the wire 26*a* has loop shape, and mass 27*a* is located at the forwardly projected turn of the loop. The wire may be adjustably attached to the wing, as by a small piece of tape 28.

The wings 23 themselves can be shipped in detached condition, in carton 20, and then attached by the user at their abutted root ends, as along line 29 in FIG. 3, tape 30 being used for the connection.

The wing sweep back angle $\alpha$ is between 5° and 50°.

Figure 12:
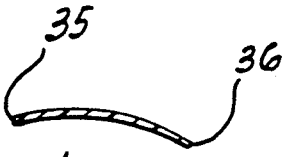
FIGS. 9–12 are chordal sections taken on lines 9—9, 10—10, 11—11, and 12—12 of FIG. 8.

In FIGS. 8-12, the unitary modified V-shaped wing 33 may be molded from lightweight plastic material, such as styrene foam, of 1 to 2 lb./ft$^3$ density, in the shape illustrated. Note that it has camber throughout its length, as indicated by sections 9-12 taken through the left section of the wing, the right section being the same. Outermost extents 34 of the wing are sharply upswept, rearwardly, by as much as 20 to 30 degrees, as seen in FIG. 12, for stability. Note local trailing edge 35 elevated higher than local leading edge 36.

Figure 11:
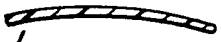
Figure 10:
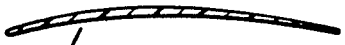
Figure 9:
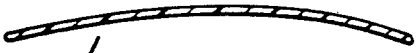
Figure 8:
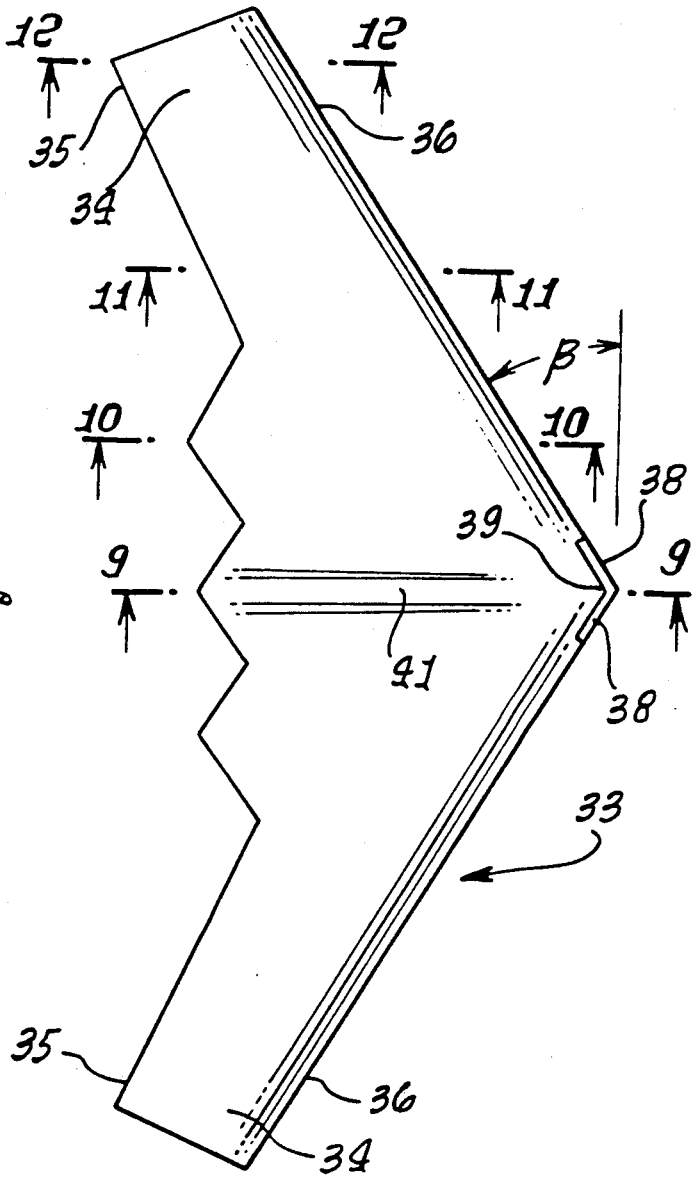
FIG. 8 is a plan view of a modified V-shaped glider wing.
Figure 15:
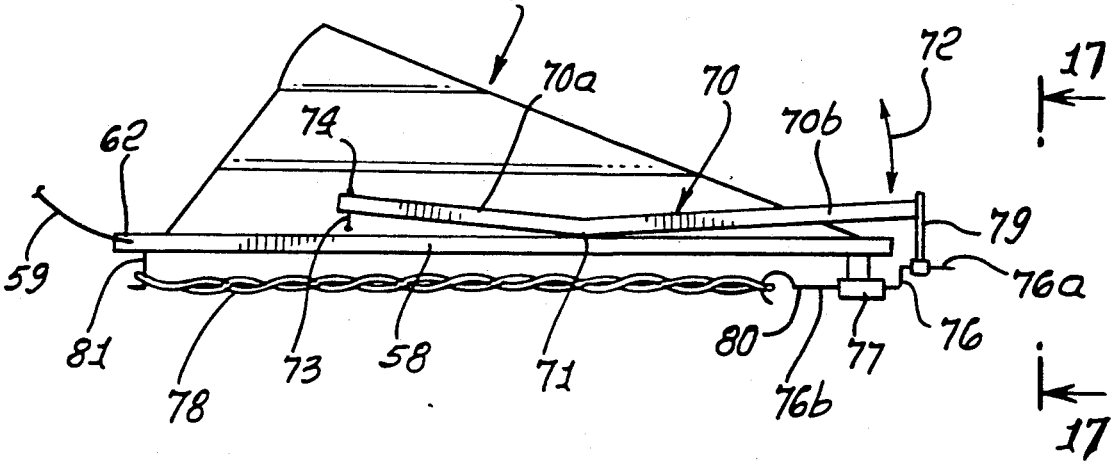
FIG. 15 is a side elevation taken on lines 15—15 of FIG. 13.
Figure 16:
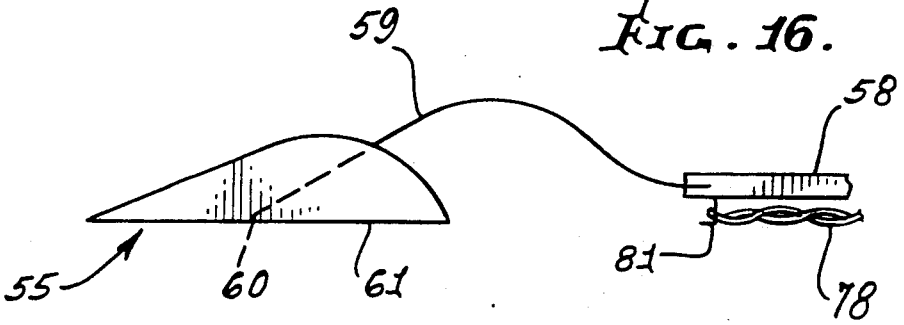
FIG. 16 is a forward continuation of FIG. 15 showing a dangling stabilizer surface.
Figure 17:
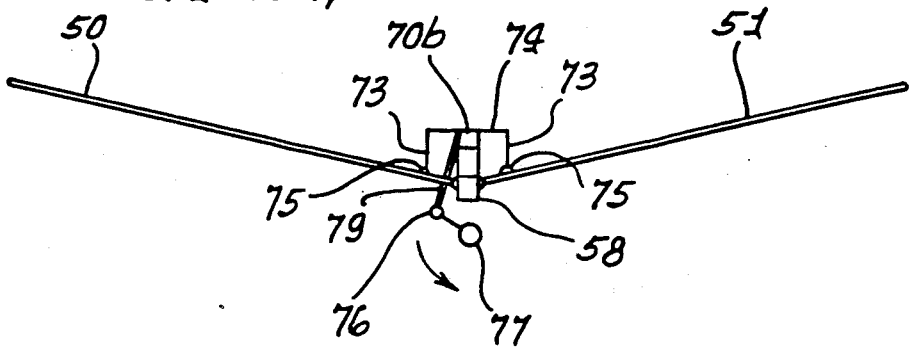
FIG. 17 is an end elevation taken on lines 17—17 of FIG. 15.

In FIGS. 9 and 10, the leading and trailing edges are at generally the same level; and in FIG. 11, the trailing edge is slightly elevated relative to the forward edge, showing progressive upsweep along the wing length between sections seen in FIGS. 11 and 12. A metallic weight 38 is attached to the nose 39 for balance and stability. Control of the wing in flight is the same as described above, i.e., using an auxiliary control surface or sheet, as for example is seen in FIG. 7 or 7*a*. The sweep-back angle $\beta$ of the wing leading edge is between 25° and 40°; the balance point is located at 41; and the left and right wing sections have dihedral, each section angled upwardly from the center at between 5° and 10° above horizontal level.

The performance and stability of the glider are achieved through use of a cambered airfoil with extreme "washout", i.e., rearwardly upswept wing tips. The camber is about 5% (height vs. length); and the upsweep angle is about 20°-30°, comparing center of wing with tips of wing. Also, there is optimum balance between glider weight and aerodynamic forces, i.e, the balance point is important, and in the design as shown, the balance point 41 is approximately mid way between the nose 39 and root 39*a*.

In regard to the above, the method of flying the toy glider includes the steps a) providing the glider with a V-shaped, swept-back wing, and a glider length dimension, mid-way of said wing, which is substantially less than the span dimension of said wind, the wing being forwardly weighted to an extent providing flight stability, b) launching the glider in a flight path, c) providing a flow deflecting surface having upwardly convex flow deflecting edges; supporting said surface on an elongated, hand held handle; orienting said handle to project below said surface and convex edges, and orienting and moving said air flow deflecting surface with said convex edges in such spaced relation to the wing of the launched glider that air is deflected in a generally upwardly direction along said edges and toward said flight path whereby an upwardly deflected column of air is formed to aid in sustaining flight of the glider, during said flight, and d) manually maneuvering said surface in relation to the flight position of the wing, to thereby control the flight path of the glider.

In FIGS. 13–17, the lightweight wing sections (plastic, etc.) 50 and 51, which are alike, may be hingedly connected at their root ends to a frame, shown in the form of a lightweight central beam 52 that extends forwardly and rearwardly. See hinge locations 53 and 54, for example. Such sections have camber, as seen in FIG. 14.

A thin, V-shaped, cross section flight stabilizer 55, forwardly elongated, is connected to dangle from a wire 59 projecting forwardly of a nose 62 defined by the wing center beam 58. The stabilizer may be formed from molded polystyrene. See wire 59 free dangling connection at 60 to the stabilizer fold 61 which projects forwardly and rearwardly. If the stabilizer sections 60*a* and 60*b*, which are alike, are folded into a single plane, a heart-shaped outline would result. The arching wire 59 may be carried by the forward end of the wing beam 58, as at 62.

An actuator is provided and is carried by the wing beam or frame 58, and is operatively connected with the wing sections 50 and 51 to displace them up and down in flapping mode, to propel and levitate the aircraft in forward flight. In this regard, the weight of the stabilizer 55 exerts torque that tilts the flapping wings so that forward propulsion results.

The actuator includes a forwardly and rearwardly extending rocking beam 70 supported by and connected to the beam or frame 58, as at pivot point 71, whereby the beam 70 may rock, as indicated by arrows 72. Links 73 are connected to opposite ends of a cross-piece 74 attached to the forward portion 70*a* of beam 70, to be displaced up and down, and to thereby flap the wing sections, to which lower ends of the links are connected, as at 75, in laterally offset relation to the frame 58. See FIG. 17.

A rotary crank 76 is carried, as via a bearing 77 suspended by the frame or beam 58, and a link 79 is pivotally connected between the crank throw 76*a* and the rocking beam rearward section 70*b*, to rock the beam 70 as the crank is rotated. Unwinding of a wound rubber band 78 exerts torque and rotates the crank. Band 78 is connected at one end to a hook 80 attached to the crank axle 76*b*, and at its opposite end to a support 81 carried by the frame 58.

The lightweight and aerodynamic design of the gliders of FIGS. 1–12 produces stable high performance flight at a very low airspeed, typically 3 to 5 mph, that is well matched to walking pace of the operator. The low speed and low mass makes this type of glider ideal for operation indoors, and results in no damage to the glider, furnishings or people, in the event of collision during flight. The low airspeed allows operation outdoors in calm wind conditions.

Outdoor operation can continue in higher wind conditions by hand launching in free flight. The high performance glide and aerodynamic stability qualities permit the glider to be thrown or launched with a thread line or rubber band to heights of 20 to 30 feet from which the glider will perform long, stable, straight or circling flights that are capable of riding gusts or thermal currents.

Skills developed in observing and learning to control the flight path of these gliders leads to a rapid progression of ability and understanding of the fundamental principles of flight.

A wide variety of games and competitions are possible with these gliders. These range from demonstrations of flying skills, performing 360° turns, slalom courses, flying under "Limbo" or over "High Jump" obstacles. The consistent and predictable flight paths of these gliders enables them to be hand-launched between two or more players in a game of throw and catch with various possibilities for straight, curved or dive-and-climb swooping flight trajectories between thrower and catcher. Precision landing targets can be set up at floor level or on table tops, similar to carrier deck landings, and various obstacle courses can be set up to be negotiated prior to landing approach.

I claim:

1. In apparatus including a toy aircraft adapted to be launched and sustained in its flight path at least in part due to upward deflection of relative air flow, the aircraft comprising a) a generally swept back, V-shaped wing of lightweight construction, and b) a weight suspended by forward extent of said wing and connected thereto, for balance thereof, c) a dangling surface connected to dangle from a wire projecting forwardly of a nose defined by the wing, the surface defining a forwardly positioned flight stabilizer, d) the wing having left and right sections that are hingedly supported to move up and down, and including an actuator carried by the wing rearwardly of said dangling surface and connected with said sections to displace them up and down.

2. The combination of claim 1 wherein said actuator includes a forwardly and rearwardly extending rocking beam supported by the wing, links connected between the wing sections and the beam to be displaced up and down by the beam, a rotary crank carried by the wing to be rotated by torque exerted by an unwinding elastomeric band, and a link operatively connected between said rotary part and said beam to rock the beam as said crank is rotated.

3. The method of flying a toy glider that includes a) providing the glider with a V-shaped, swept-back wing, and a glider length dimension, mid-way of said wing, which is substantially less than the span dimension of said wing, the wing being forwardly weighted to an extent providing flight stability, b) launching the glider in a flight path, c) providing a flow deflecting surface having upwardly convex flow deflecting edges; supporting said surface on an elongated, hand held handle; orienting said handle to project below said surface and convex edges, and orienting and moving said air flow deflecting surface with said convex edges in such spaced relation to the wing of the launched glider that air is deflected in a generally upwardly direction along said edges and toward said flight path whereby an upwardly deflected column of air is formed to aid in sustaining flight of the glider, during said flight, and d) manually maneuvering said surface in relation to the flight position of the wing, to thereby control the flight path of the glider.

4. The method of claim 3 wherein said maneuvering step includes relatively forwardly advancing said deflecting surface generally parallel to and beneath the flight path of the glider, while maintaining said surface angled upwardly and rearwardly relative to the direction of forward advancement.

5. The method of claim 4 including further maneuvering said surface leftwardly or rightwardly relative to the wing, to alter said upwardly deflected air flow in a manner to cause the glider to execute a turn.

6. The method of claim 4 wherein said forwardly advancing step is carried out by a person walking forwardly.

7. A toy aircraft comprising:

a) a wing of lightweight construction, and a frame to which the wing is operatively connected to allow up and down flapping of left and right wing sections, b) a stabilizer surface connected to dangle from a wire projecting forwardly relative to the wing, the wire carried by the frame, c) and an actuator carried by the frame and connected with said wing sections to displace them in up and down flapping mode, d) the actuator including a beam-rockingly supported by the frame, there being means connected between the wind sections and the beam to be displaced up and down by the beam, a rotary crank carried by the frame to be rotated by torque exerted by an unwinding elastomeric band, and means operatively connected between said rotary crank and said beam to rock the beam as said crank is rotated.

8. A toy aircraft comprising:

a) a wing of lightweight construction, and a frame to which the wing is operatively connected to allow up and down flapping of left and right wing sections, b) a stabilizer surface connected to dangle from a wire projecting forwardly relative to the wind, the wire carried by the frame, c) and an actuator carried by the frame and connected with said wing sections to displace them in up and down flapping mode, d) the actuator including a forwardly and rearwardly extending rocking beam supported by the frame, links connected between the wing sections and the beam to be displaced up and down by the beam, a rotary crank carried by the frame to be rotated by torque exerted by an unwinding elastomeric band, and a link operatively connected between said rotary crank and said beam to rock the beam as said crank is rotated.

* * * * *